US010556776B2

(12) United States Patent
Zhao et al.

(10) Patent No.: US 10,556,776 B2
(45) Date of Patent: Feb. 11, 2020

(54) LIGHTWEIGHT ELEVATOR TRAVELING CABLE

(71) Applicant: OTIS ELEVATOR COMPANY, Farmington, CT (US)

(72) Inventors: Chen qian Zhao, Newark, DE (US); Kyle B. Martin, Avon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/950,212

(22) Filed: Apr. 11, 2018

(65) Prior Publication Data

US 2018/0339882 A1 Nov. 29, 2018

Related U.S. Application Data

(60) Provisional application No. 62/509,926, filed on May 23, 2017.

(51) Int. Cl.

| | |
|---|---|
| ***B66B 7/06*** | (2006.01) |
| ***H01B 7/00*** | (2006.01) |
| ***H01B 7/02*** | (2006.01) |
| *H01B 9/00* | (2006.01) |

(52) U.S. Cl.

CPC ..... *B66B 7/064* (2013.01); *H01B 7/0009* (2013.01); *H01B 7/02* (2013.01); *H01B 9/003* (2013.01)

(58) Field of Classification Search

CPC ..... B66B 7/06; B66B 7/064; B66B 7/1238; B66B 9/00; D07B 1/02; D07B 1/025; D07B 1/145; D07B 1/147; D07B 1/162; D07B 1/165; H01B 7/0009; H01B 7/02; H01B 7/00; H01B 7/18; H01B 7/182; H01B 7/226; H01B 7/14; H01B 7/045; H01B 7/0072; H01B 9/003; H01B 9/005; H01B 11/22

USPC ..... 174/110 R, 70 R; 187/254

See application file for complete search history.

(56) References Cited

U.S. PATENT DOCUMENTS

| | | | | |
|---|---|---|---|---|
| 4,728,698 A * | 3/1988 | Isayev | C08L 69/00 264/108 |
| 5,138,684 A * | 8/1992 | Bullock | G02B 6/443 385/102 |
| 5,218,171 A | 6/1993 | Aldissi | |
| 6,164,053 A | 12/2000 | O'Donnell et al. | |

(Continued)

FOREIGN PATENT DOCUMENTS

| | | | |
|---|---|---|---|
| CN | 102623083 A | 8/2012 | |
| CN | 203402786 U * | 1/2014 | B66B 7/00 |

(Continued)

OTHER PUBLICATIONS

Examination Report No. 1 for standard patent application, Australian Application No. 2018202730 dated Dec. 21, 2018.

(Continued)

*Primary Examiner* — Timothy J Thompson
*Assistant Examiner* — Guillermo J Egoavil
(74) *Attorney, Agent, or Firm* — Carlson, Gaskey & Olds

(57) ABSTRACT

An illustrative example elevator traveling cable includes a plurality of conductors configured for conducting at least one of electrical energy and communication signals. A jacket covers the plurality of conductors. At least one load bearing member supports a weight of the traveling cable and comprises liquid crystal polymer.

13 Claims, 2 Drawing Sheets

(56) References Cited

U.S. PATENT DOCUMENTS

| | | | | |
|---|---|---|---|---|
| 6,886,666 | B2 | 5/2005 | Stucky et al. | |
| 7,828,121 | B2 | 11/2010 | Parrini | |
| 8,100,796 | B2 | 1/2012 | O'Donnell | |
| 9,466,404 | B2 | 10/2016 | Guthrie | |
| 2007/0179577 | A1* | 8/2007 | Marshall | A61N 1/056 607/116 |
| 2008/0142310 | A1* | 6/2008 | Kocher | B66B 9/00 187/266 |
| 2010/0133046 | A1* | 6/2010 | Allwardt | B66B 7/08 187/251 |
| 2011/0000746 | A1 | 1/2011 | Pelto-Huikko et al. | |
| 2011/0214351 | A1* | 9/2011 | Furuya | B23P 11/00 49/197 |
| 2011/0259677 | A1 | 10/2011 | Dudde et al. | |
| 2012/0021218 | A1 | 1/2012 | Lee et al. | |
| 2013/0048373 | A1* | 2/2013 | Fogg | H01B 7/045 174/70 R |
| 2014/0345978 | A1* | 11/2014 | Alasentie | B66B 7/064 187/254 |
| 2015/0101888 | A1 | 4/2015 | Pelto-Huikko | |
| 2015/0194795 | A1 | 7/2015 | Rohr et al. | |
| 2015/0307322 | A1* | 10/2015 | Peacock | B66B 7/064 187/254 |

FOREIGN PATENT DOCUMENTS

| | | | |
|---|---|---|---|
| CN | 104203792 | A | 12/2014 |
| DE | 3813338 | A1 | 11/1989 |
| EP | 2821357 | A1 | 1/2015 |
| EP | 2767496 | B1 | 3/2017 |
| JP | 2015048178 | A | 3/2015 |
| WO | 2013/140038 | | 9/2013 |

OTHER PUBLICATIONS

The Extended European Search Report for EP Application No. 18173265.2, dated Nov. 6, 2018.

Search Report for CN Application 2018105007113 dated Apr. 26, 2019.

* cited by examiner

LIGHTWEIGHT ELEVATOR TRAVELING CABLE

CROSS REFERENCE TO RELATED APPLICATIONS

This application claims priority to U.S. Provisional Application No. 62/509,926, which was filed on May 23, 2017.

BACKGROUND

Elevator systems typically include an elevator car situated for movement within a hoistway. A traveling cable is associated with the elevator car for providing power to electrical components on the car. The traveling cable is also used for communicating signals between car-based components, such as a car operating panel, and other portions of the elevator system.

In high-rise and ultra-high-rise buildings, the weight of the traveling cable is substantial because of its length. While such weight can be useful as part of a compensation arrangement, there are drawbacks associated with some conventional traveling cables. For example, in ultra-high-rise elevator systems, the weight of the cable itself may present difficulties in supporting the cable. Additionally, a heavier traveling cable requires additional power for lifting the elevator car under some circumstances.

SUMMARY

An illustrative example elevator traveling cable includes a plurality of conductors configured for conducting at least one of electrical energy and communication signals. A jacket covers the plurality of conductors. The traveling cable includes at least one load bearing member. The load bearing member supports a weight of the traveling cable and comprises liquid crystal polymer.

In an example embodiment having one or more features of the elevator traveling cable of the previous paragraph, the at least one load bearing member consists solely of liquid crystal polymer.

In an example embodiment having one or more features of the elevator traveling cable of either of the previous paragraphs, the at least one load bearing member comprises a plurality of load bearing members each comprising liquid crystal polymer.

In an example embodiment having one or more features of the elevator traveling cable of any of the previous paragraphs, at least some of the conductors comprise a liquid crystal polymer central core and at least one metallic coating over the core.

In an example embodiment having one or more features of the elevator traveling cable of any of the previous paragraphs, the at least one load bearing member is situated inside the jacket.

An illustrative example embodiment of an elevator system includes an elevator traveling cable having one or more features of the elevator traveling cable of any of the previous paragraphs.

Various features and advantages of at least one disclosed example embodiment will become apparent to those skilled in the art from the following detailed description. The drawings that accompany the detailed description can be briefly described as follows.

DETAILED DESCRIPTION

Figure 1:
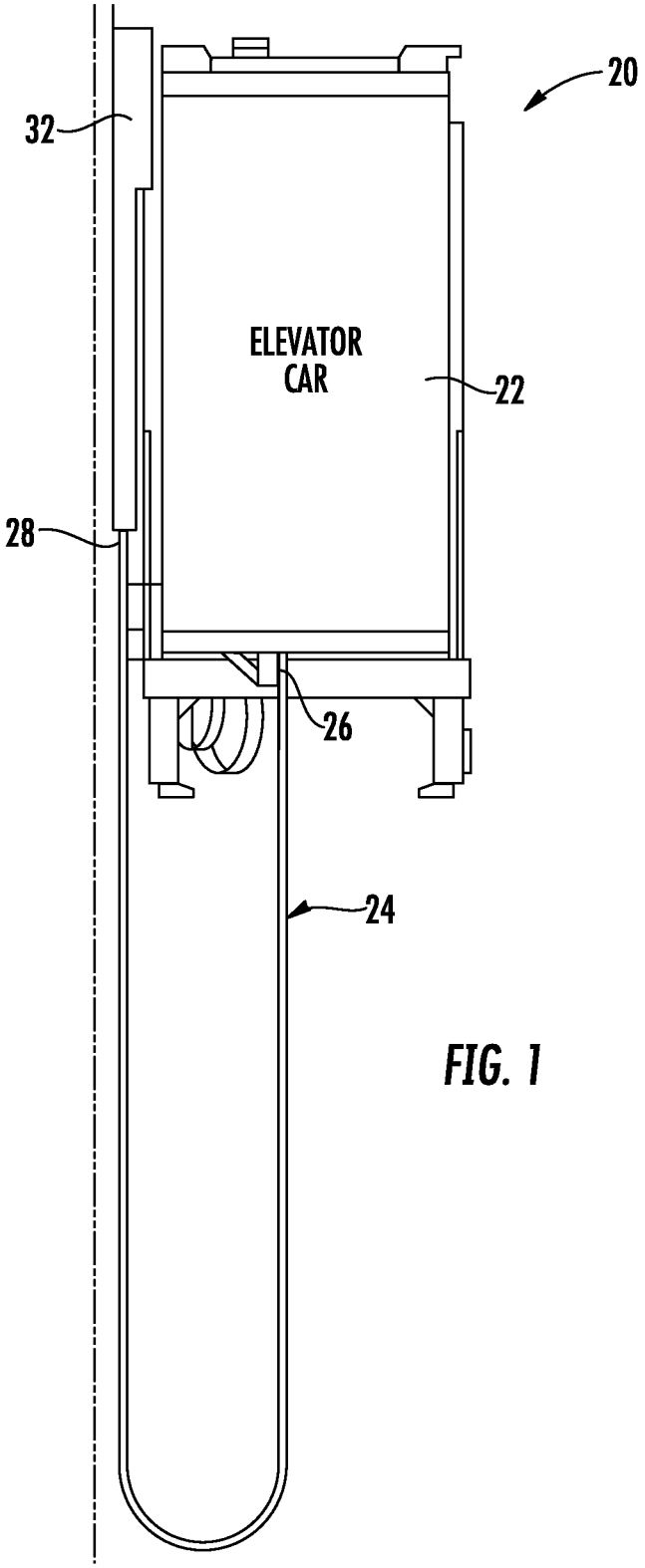
FIG. 1 schematically illustrates selected portions of an elevator system including a traveling cable designed according to an embodiment of this invention.

FIG. 1 schematically illustrates selected portions of an elevator system 20. An elevator car 22 has an associated traveling cable 24. One end 26 of the traveling cable is coupled with the elevator car 22 while an opposite end 28 of the traveling cable 24 is coupled with a signaling and power source device 32. The traveling cable 24 facilitates providing electrical power to components within the elevator car 22. The traveling cable 24 also facilitates communicating signals between the elevator car 22 and the device 32 for purposes such as registering calls with the elevator controller based on a passenger selection of a destination on a car operating panel (not illustrated) in the elevator car 22.

Figure 2:
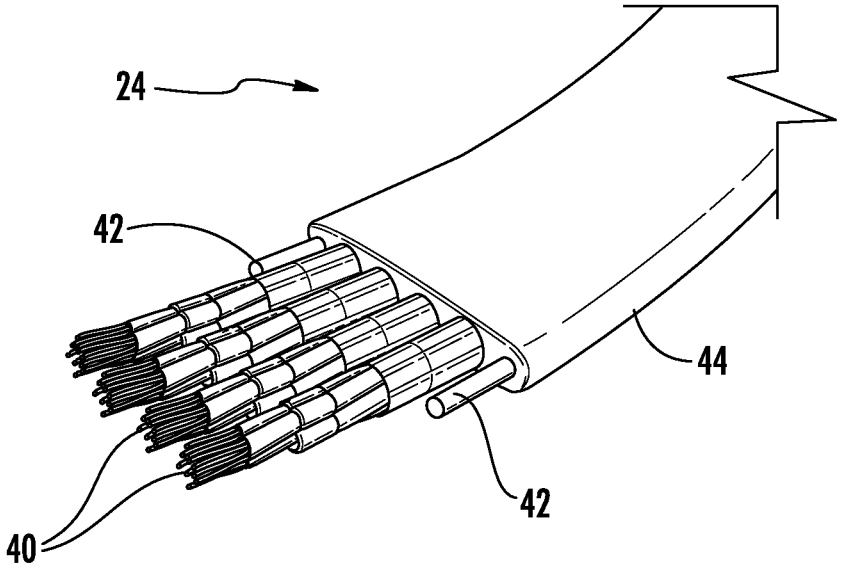
FIG. 2 diagrammatically illustrates selected portions of an elevator traveling cable designed according to an embodiment of this invention.

FIG. 2 shows an example embodiment of a traveling cable 24. A plurality of conductors 40 and a plurality of load bearing members 42 are situated within a jacket 44. The conductors 40 carry electrical energy, signals, or both between the elevator car 22 and the device 32, for example. The load bearing members 42 support the load or weight of the traveling cable 24 and provide a strengthening reinforcement for the cable 24. The arrangement of conductors 40 and load bearing members 42 may be varied from the particular configuration shown in FIG. 2, which is provided as an example for discussion purposes.

The load bearing members 42 comprise liquid crystal polymer fibers. In one example, the liquid crystal polymer is an aromatic polyester produced by poly-condensation of 4-hydroxybenzoic acid and 6-hydroxynaphthalene-to-carboxylic acid. The liquid crystal polymer renders the load bearing members 42 lightweight and high-strength. In some examples, the entire load bearing members 42 consist solely of liquid crystal polymer material. In other examples, the load bearing members 42 comprise a combination of liquid crystal polymer with at least one other light weight, high strength fiber. Example fibers used in such embodiments include glass, ultrahigh molecular weight polyethylene/polypropylene, polybenzoxazole, nylon, and carbon. Liquid crystal polymer is combined with such fibers in a matrix system in some embodiments.

One feature of the liquid crystal polymer load bearing members is that they are lighter per unit volume than a steel or carbon fiber load bearing member. Additionally, carbon fiber or glass fiber requires a matrix but liquid crystal polymer does not. These features contribute to the superior performance and better economies of the load bearing members 42 compared to other types.

In one example embodiment, the load bearing members 42 comprise VECTRAN™ available from Kuraray Company, Ltd.

Figure 3:
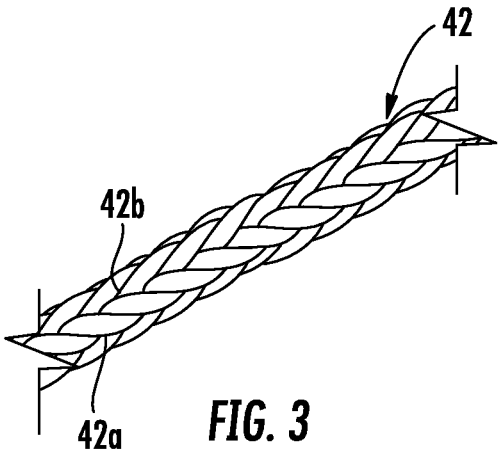
FIG. 3 illustrates an example load bearing member comprising a liquid crystal polymer.

FIG. 3 illustrates an example configuration of an embodiment of a load bearing member 42. In this example, long fibers of liquid crystal polymer are braided together to establish a rope-like configuration of the load bearing member 42.

Figure 4:
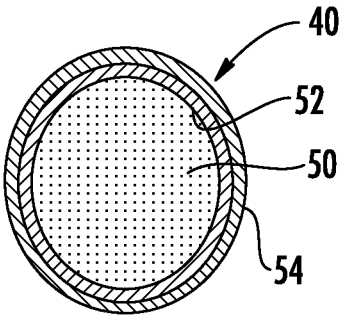
FIG. 4 is a cross-sectional illustration of an example conductor comprising a liquid crystal polymer core.

In some embodiments, the conductors 40 also comprise liquid crystal polymer. FIG. 4 is a cross-sectional illustration of one such example conductor. A central core 50 of liquid crystal polymer is coated with two layers of metallic coating 52 and 54. The liquid crystal polymer core 50 renders the conductor 40 lighter weight and higher strength than a purely metallic conductor, such as one made of solid copper. A conductor 40 as shown in FIG. 4 contributes to making the traveling cable 24 lighter weight and higher strength compared to a conventional traveling cable that has all metallic conductors.

Embodiments of this invention provide a lighter weight traveling cable that can simplify the portions of an elevator system required for supporting and accommodating a traveling cable. Additionally, a traveling cable designed according to an embodiment of this invention reduces overall system weight especially in ultra-high-rise installations.

The preceding description is illustrative rather than limiting in nature. Variations and modifications to that which is discussed above and shown in the drawings are possible. Such variations and modifications do not necessarily depart from the essence of this invention. The scope of legal protection given to this invention can only be determined by studying the following claims.

We claim:

1. An elevator traveling cable, comprising:
a plurality of conductors configured for conducting at least one of electrical energy and communication signals to at least one component of an associated elevator car;
a jacket covering the plurality of conductors; and
at least one load bearing member supporting a weight of the traveling cable, wherein the at least one load bearing member consists solely of liquid crystal polymer.

2. The elevator traveling cable of claim 1, wherein the at least one load bearing member comprises a plurality of load bearing members each comprising liquid crystal polymer.

3. The elevator traveling cable of claim 1, wherein at least some of the conductors comprise a liquid crystal polymer central core and at least one metallic coating over the core.

4. The elevator traveling cable of claim 1, wherein the at least one load bearing member is situated within the jacket.

5. An elevator system including the elevator traveling cable of claim 1.

6. An elevator traveling cable, comprising:
a plurality of conductors configured for conducting at least one of electrical energy and communication signals to at least one component of an associated elevator car, wherein at least some of the conductors comprise a liquid crystal polymer central core and at least one metallic coating over the core;
a jacket covering the plurality of conductors; and
at least one load bearing member supporting a weight of the traveling cable, the at least one load bearing member consisting solely of liquid crystal polymer.

7. The elevator traveling cable of claim 6, wherein the at least one load bearing member comprises a plurality of load bearing members each comprising liquid crystal polymer.

8. The elevator traveling cable of claim 6, wherein the at least one load bearing member is situated within the jacket.

9. An elevator system including the elevator traveling cable of claim 6.

10. The elevator traveling cable of claim 6, wherein the at least one load bearing member does not include a matrix.

11. The elevator traveling cable of claim 6, wherein the at least one load bearing member comprises a plurality of long fibers of the liquid crystal polymer that are braided together.

12. The elevator traveling cable of claim 1, wherein the at least one load bearing member does not include a matrix.

13. The elevator traveling cable of claim 1, wherein the at least one load bearing member comprises a plurality of long fibers of the liquid crystal polymer that are braided together.

* * * * *